US011649705B2

(12) United States Patent
Berland

(10) Patent No.: US 11,649,705 B2
(45) Date of Patent: May 16, 2023

(54) OIL AND GAS WELL CARBON CAPTURE SYSTEM AND METHOD

(71) Applicant: Robert J Berland, Olathe, KS (US)

(72) Inventor: Robert J Berland, Olathe, KS (US)

( * ) Notice: Subject to any disclaimer, the term of this patent is extended or adjusted under 35 U.S.C. 154(b) by 73 days.

(21) Appl. No.: 17/202,882

(22) Filed: Mar. 16, 2021

(65) Prior Publication Data

US 2021/0262327 A1 Aug. 26, 2021

Related U.S. Application Data

(63) Continuation-in-part of application No. PCT/US2020/020473, filed on Feb. 28, 2020, which is a continuation-in-part of application No. 16/110,945, filed on Aug. 23, 2018, now Pat. No. 10,947,821.

(60) Provisional application No. 62/549,036, filed on Aug. 23, 2017.

(51) Int. Cl.

| | |
|---|---|
| ***E21B 34/02*** | (2006.01) |
| ***E21B 43/12*** | (2006.01) |
| ***E21B 43/34*** | (2006.01) |
| ***F04B 47/02*** | (2006.01) |

(52) U.S. Cl.

CPC ..... *E21B 43/126* (2013.01); *E21B 34/025* (2020.05); *E21B 43/34* (2013.01); *F04B 47/02* (2013.01); *E21B 2200/20* (2020.05); *E21B 2200/22* (2020.05)

(58) Field of Classification Search

CPC ..... E21B 34/02; E21B 34/025; E21B 43/126; E21B 43/128; E21B 43/34; E21B 2200/22; F04B 47/02

See application file for complete search history.

(56) References Cited

U.S. PATENT DOCUMENTS

| | | | | |
|---|---|---|---|---|
| 3,851,995 | A | 12/1974 | Mills | |
| 5,655,603 | A | 8/1997 | Schulte et al. | |
| 6,119,781 | A * | 9/2000 | Lemetayer | E21B 43/128 166/369 |

(Continued)

OTHER PUBLICATIONS

"International Search Report and Written Opinion; PCT/US2020/020473", dated May 20, 2020.

(Continued)

*Primary Examiner* — Matthew R Buck

(74) *Attorney, Agent, or Firm* — Law Office of Mark Brown, LLC; Mark E. Brown

(57) ABSTRACT

An oil and gas well carbon capture system includes a controller configured for minimizing or eliminating natural gas flaring and venting. A downhole pump is driven by a motor connected to the controller, which interactively operates a control valve. Controller inputs include gas pressures, pump motor speed and oil and gas delivery. The system is configured for separating production phases comprising oil, water and natural gas. A pressure transducer monitors output to gas sales, which can also be monitored with a digital flow meter. A carbon capture method for oil and gas production is also provided. The controls system maximizes downhole pump efficiency and oil and gas production by interactively monitoring and controlling well operating parameters. A method embodying the present invention optimizes well production and operating efficiency.

16 Claims, 19 Drawing Sheets

(56) References Cited

U.S. PATENT DOCUMENTS

| | | | | |
|---|---|---|---|---|
| 7,090,027 | B1 | 8/2006 | Williams | |
| 7,219,747 | B2 | 5/2007 | Gleitman et al. | |
| 9,127,774 | B2 | 9/2015 | Wilde et al. | |
| 10,029,291 | B2 * | 7/2018 | Fischer | E21B 43/12 |
| 10,865,635 | B2 * | 12/2020 | Singal | E21B 47/06 |
| 2007/0012442 | A1 | 1/2007 | Hearn | |
| 2008/0262736 | A1 * | 10/2008 | Thigpen | E21B 43/128 702/9 |
| 2014/0130676 | A1 * | 5/2014 | Daniels | B01D 19/0042 96/194 |
| 2014/0166267 | A1 | 6/2014 | Weightman et al. | |
| 2014/0262238 | A1 * | 9/2014 | McCrickard | E21B 43/121 166/250.01 |
| 2015/0226045 | A1 | 8/2015 | Fischer et al. | |
| 2016/0084042 | A1 * | 3/2016 | VanDam | E21B 43/12 166/250.03 |
| 2018/0119540 | A1 | 5/2018 | Boscan Castillo | |
| 2019/0063194 | A1 * | 2/2019 | Berland | E21B 47/06 |
| 2021/0140290 | A1 * | 5/2021 | Eslinger | E21B 43/12 |

OTHER PUBLICATIONS

Wikipedia, "Oil Well", https://en.wikipedia.org/wiki/Oil_well, Aug. 2, 2018, 1-5.

* cited by examiner

To FIG. 3b

Note 1 Motor Control may be simply ON/OFF via digital contact control or variable speed via variable frequency/speed drive.

OIL AND GAS WELL CARBON CAPTURE SYSTEM AND METHOD

CROSS-REFERENCE TO RELATED APPLICATION

This application is a continuation-in-part (CIP) of and claims priority in PCT/US20/20473, filed Feb. 28, 2020; is related to U.S. Non-Provisional patent application Ser. No. 16/110,945, filed Aug. 23, 2018, which is a non-provisional of U.S. Provisional Patent Application No. 62/549,036 Filed Aug. 23, 2017, all of which are incorporated herein by reference.

BACKGROUND OF THE INVENTION

1. Field of the Invention

The present invention relates generally to improving currently-used artificial lift systems and methods for the production of oil, natural gas and water from vertical and horizontal wellbores, and methods of use thereof, and more specifically to optimizing well and field productivity in addition to lowering power usage by improving pump efficiency leading to lower operating costs on a per unit basis, optimal field and well production, less-frequent pump failures and minimizing or eliminating natural gas flaring and venting. This benefits carbon capture, operating costs, future capital costs, and in certain cases revenue due to an increase in recoverable reserves at the well and field level while reducing or eliminating natural gas wastage via flaring and venting.

2. Description of the Related Art

Current production methods for wells on artificial lift with natural gas production tend to be inefficient from the aspect of the pump and input power usage. Gas enters the pump, which lowers pump efficiency, decreases pump life and generally creates problems for operating the well. When operators use intermittent timing cycles to operate the pump, the timing cycle is based on the well-operator-inputs to a manual type clock and timer. There is no feedback loop in the described traditional currently-used system that allows for optimizing both pump and well performance based on actual real-time data collected at the well, nor is there commonly a mechanism used to maximize pump efficiency driven by a real time feedback loop. This lack of real-time data analysis also provides no predictive maintenance information on pump operation and increases outage times when sudden pump failures occur.

Another production method sometimes used involves incorporating what is known as a "Pump Off Controller" (POC) procedure, which attempts to maximize the pumping-system (not necessarily the well producing horizon itself) efficiency by measuring operating parameters such as the stress/strain relationship on the polish rod, and possibly input parameters at the prime mover. POCs do include feedback via parameters being measured, but the overall system efficiency is limited due to changing flow regimes at the pump intake, and are beyond the control of the POC.

Still further, current oil and gas production methodologies rely on venting and flaring excess natural gas. Such practices give rise to environmental concerns. Moreover, they compromise overall system efficiencies.

Heretofore, there has not been available a system or method for using real-time, instantaneous well performance data to optimize well production by recognizing changing downhole flow regimes and actively changing same to improve power system and pump efficiency performance, and further increasing reservoir production and recovery factors, with the advantages and features of the present invention. Moreover, there has not been available a system or method with the carbon capture advantages of the system and method of the present invention.

SUMMARY OF THE INVENTION

The present invention generally provides a novel carbon capture system and method for using data acquired at the well by gas metering and taking advantage of the relationship between flow rate and impact on flow regimes in the well in such a way as to optimize the reservoir performance of the well, increasing down-hole pump efficiency, reducing input power requirements, providing pump predictive maintenance information, minimizing or eliminating natural gas flaring and venting, and optimizing carbon capture across the entire gathering system when used in a field-wide application.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning. Well "backside" refers to the annular space between the well tubing and casing, and is the conduit of production for the gas stream and any liquids the well can produce while flowing naturally. Tubing refers to a small diameter pipe system that, in an artificially lifted well, is intended to be the conduit of travel for liquid phases of both oil and water. Well "loading" refers to a state of gas flow that is impeded by simultaneous liquids production that slows the rate of gas flow rate, ultimately to a no-flow condition if loading is allowed to continue.

II. Systems Embodying Aspects of the Invention

Figure 1:
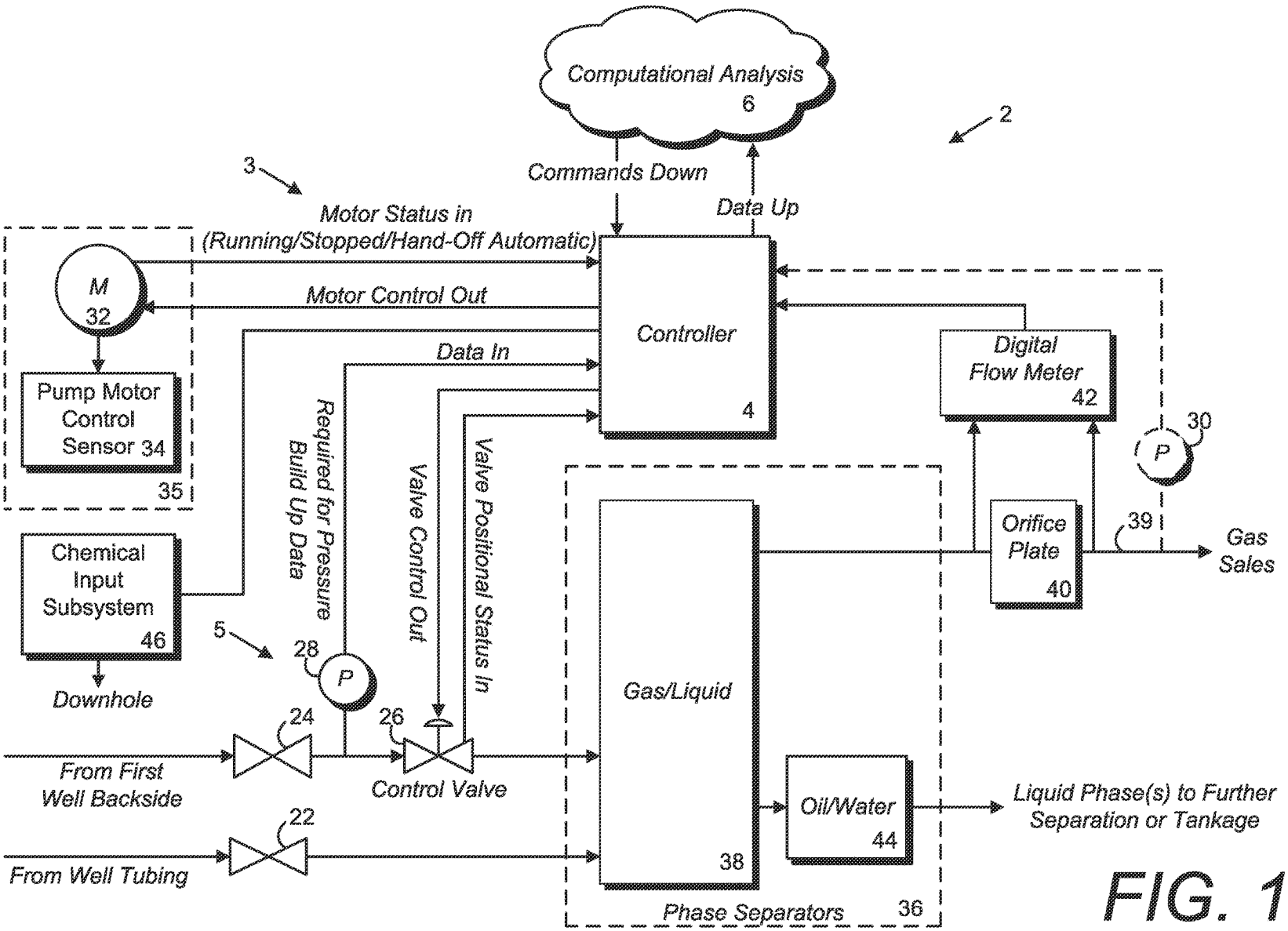
FIG. 1 is a schematic, block diagram of an oil and gas production well system embodying an aspect of the present invention.
Figure 2:
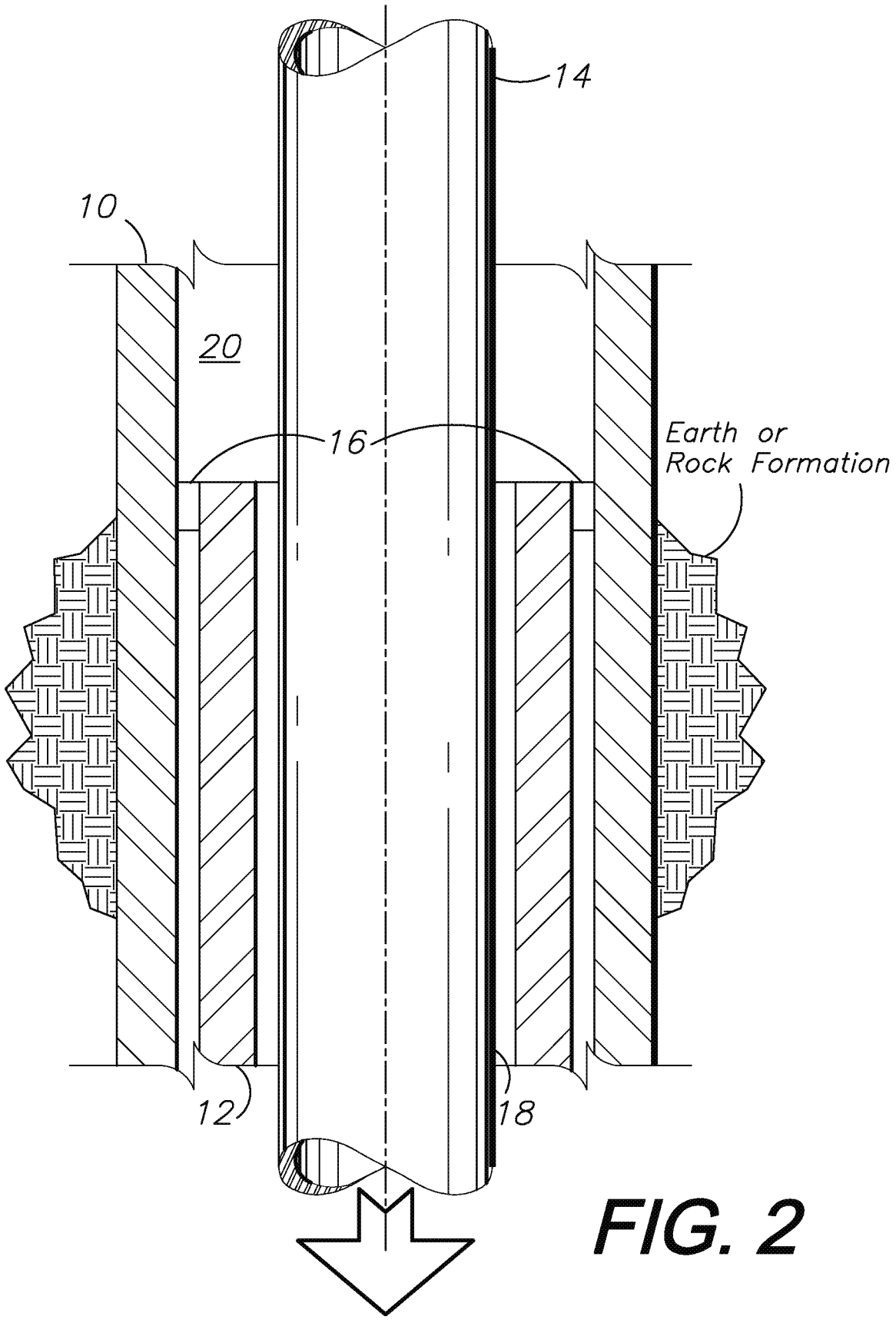
FIG. 2 is a fragmentary, elevational view of an oil and gas production wellstring

FIG. 1 shows an oil and gas production well control system 2 including a well 3 and a controller 4. The controller 4 can be connected to the Internet (i.e., "cloud") 6, e.g., wirelessly or directly. The system 2 can perform computational analysis in the cloud 6 by providing data input from the controller 4, which can download commands from the cloud 6. Alternatively, data processing and system control functions can be provided by a standalone computer or a network of computers. Still further, such processing capability can be incorporated in "smart" components of the system 2.

The system 2 includes a wellstring (multiple production wells can be included in the system and driven by a single-point cloud/software system). Conventional production wellstrings can include an outermost casing 10, an intermediate liner 12 and an innermost tubing 14. Such production wellstring components can be installed downhole as individual sections connected at their respective ends. Casings 10 can be cast-in-place downhole. Liners 12 commonly terminate subsurface, and can be suspended from the casing 10 by hangers 16. U.S. Pat. No. 7,090,027 shows casing hanger assemblies, and is incorporated herein by reference. The wellstring includes a first backside 18 comprising an annular space between the liner 12 and the tubing 14. A second backside 20 comprises an annular space between the casing 10 and the tubing 14. The wellstring is connected to a pump subsystem 35, which includes a motor 32 and a pump motor control sensor 34. The pump subsystem motor 32 can reciprocate a conventional pump jack (not shown), or drive various other downhole pump configurations such as progressive cavity and electric submersible pumps. Various alternative production well constructions can include the control system and perform the method of the present invention.

As shown in FIG. 1, well tubing production (generally oil and water in liquid phase) exits a wellhead 5 via a tubing valve 22 and backside 20 production (generally gas, which can include entrained liquids) exits the wellhead 5 via a backside valve 24, which flows through a control valve 26 connected to the controller 4. The controller 4 can be programmed to provide positioning signals to the control valve 26 in response to controller input, including control valve 26 positional status, preprogrammed operating parameters and conditions, and pressure data detected at upstream and downstream transducers 28, 30, which data can be utilized in computing system output flow rates.

The controller 4 is also interactively connected to a motor or prime mover 32, which can include a pump motor control/sensor 34. The motor 32 can utilize variable frequency drive ("VFD") technology. Motor 32 status conditions can be running, stopped or hand-off automatic ("HOA"), which status conditions can be input to the controller 4.

Production enters a phase separator subsystem 36 via the valves 22, 26. The phase separator subsystem 36 includes a gas/liquid phase separator 38 wherein gas and liquid (i.e., oil and water) phases are separated, preferably at the surface. The gas flow proceeds down a sales line 39 that typically includes a differential pressure ($P_{DIFF}$) meter 42 to monitor and record the natural gas production. This measurement is done using typical gas parameters as a function of temperature and pressure, as well as using an orifice plate 40 of known restriction such that the instantaneous production rate can be calculated via the measured pressures on either side of the orifice plate 40. A difference in pressure between these two points of measurement ($P_{DIFF}$) indicates flow rate. The instantaneous well gas production is directly proportional to the $P_{DIFF}$ recorded at the meter 42, which records both orifice plate 40 well side and flowline side measured pressures, the calculated $P_{DIFF}$, and the calculated production flow rate as functions of time via an internal clock.

The production flow rate can be input to the controller 4. Alternatively, $P_{DIFF}$ can be independently derived from the upstream and downstream pressure transducers 28, 30. It should be noted that if data from a flow meter is available to the system for $P_{DIFF}$, then pressure transducer 30 is not required as part of the system. Custody (ownership) of the gas output can transfer at the digital flow meter 42, which operates as a discrete external input source. Alternatively, the custody transfer can occur downstream whereby the alternative configuration design choice based on an as-built design at the well site with upstream and downstream pressure transducers 28, 30 may be preferred. Such $P_{DIFF}$ is proportional to gas flow volume throughput and can provide quantity data as needed for the gas sales line 39 downstream of the system 2. Liquid output from the gas/liquid separator 38 enters an oil/water separator 44, and exits to further separation, disposal, oil sales, tankage, etc.

The system 2 uses instantaneous $P_{DIFF}$ information and, via computation in a proprietary algorithm using cloud architecture, determines the optimal state of operation of both the downhole pump (controlled by the motor 32 located at the surface wellhead 5) and the automated control valve 26 between the well first backside or annulus 18 and the gas/liquid separator 38, as shown in FIG. 1. The upstream pressure measurement transducer 28 (between the wellhead 5 and the control valve 26) inputs pressure data to the controller 4 for use with flow meter 42 data. The $P_{DIFF}$ can be supplied by the flow meter 42, or if this is not feasible, by using the wellhead upstream pressure transducer 28 in combination with the (optional) downstream transducer 30 inserted into the flowline on the downstream side of the orifice plate 40. The control system 2 is pump "agnostic" and can be used with reciprocating tubing insert pumps, progressive cavity pumps, electric submersible pumps, etc.

In a high gas-flow-rate condition via the second back side 20, the operating downhole pump subsystem 35 will intake gas as well as liquids during the pumping cycle. In the same condition, the flow meter 42 will register a 'high' $P_{DIFF}$.

During this condition there is no need to operate the pump subsystem 35, and the system 2 recognizes this regime condition and optimizes by the well controller 4 opening the control valve 26 and maintaining the downhole pump subsystem 35 condition in "Off." As the well 3 continues to operate in this condition, both liquids and gas are flowing into the well 3, and both are attempting to flow via the backside 18. As the bottom hole pressure of the well struggles to lift both the liquids and gas from the well 3 due to an increase (gradual or sudden) in dynamic head, the flow rate decreases. This will be evidenced as decreasing $P_{DIFF}$ at the flow meter 42 (or independently derived as described elsewhere if flow meter 42 is not available). The cloud software 6 will continue monitoring $P_{DIFF}$ until the logic determines a necessity to close the control valve 26 and begin a pumping condition cycle.

When the controller 4 initiates the pumping condition, the control valve 26 is automatically closed, halting fluid upflow in the first backside 18 ($V_{UPFLOW}=0$). Gravity segregation will naturally occur in this zero-velocity backside environment, and the liquid phases will 'fall' to the bottom of the well 3 for intake by the pump subsystem 35.

A chemical input subsystem 46 can be connected to the well 3 and controlled by the controller 4 for controlling well treatment. Treatment plans are commonly implemented with such chemical input subsystems, which can inject anti-scaling, paraffin-eliminating and other control chemicals downhole. As the $P_{DIFF}$ naturally decreases after a flowing cycle and immediately after shutting in the control valve 26, the controller 4 would initiate operation of the chemical input subsystem 46 (e.g., pumps) to place chemicals in the backside (18 and/or 20) of the well 3 as it changes state from production to gravity segregation in a pumping cycle.

The controller 4 will then start the bottom-hole pump subsystem 35 via the (surface or downhole, depending on lift system employed at well) motor 32 and commence pumping since liquids are now at the pump intake and gas is segregating upward, thus creating a rising pressure seen at the pressure transducer 28 located near the control valve 26. The cloud 6 can either be programmed to calculate the fluid production based on well operating parameters, or a sensor 34 can be added to the system 2 to actually measure the pump motor rotations or stroke rates with this data supplied to the controller 4, thus enabling a more robust liquid production calculation.

The cloud 6 can incorporate machine learning techniques to optimize the well production as a function of run time of the pump subsystem 35, as well as establishing well performance optimization based on analysis of various pressure build up and flow-down rates and time frames seen at the control valve pressure transducer 28 and $P_{DIFF}$, respectively. Certain wellbore construction and operating parameters can be input into the software architecture and the software will determine superficial gas velocities for all wellbore topologies present. The system 2 will estimate critical velocities for each discrete wellbore topology and will use this information as a baseline for determining the starting point for the shut-in state of the system 2, thus maximizing the in situ well energy and thereby increasing both the life and the expected ultimate reserves recovery of the well. During the shut-in phase, the system 2 will monitor, record and learn from the nature of the pressure buildup: slope(s) of buildup, time to build to certain pressures, etc. The cloud 6 can be programmed to perform a Fast Fourier Transform on each buildup pressure and note the frequency domain and distribution of same, comparing each signature with various production and pressure buildup characteristics as an aid in determining when various production stages are contributing to wellbore fillage and production.

The control system 2 can warn of impending pump failure by continually analyzing the time cycle duration and subsequent number of pump strokes required to obtain a given backside pressure buildup. The control system 2 will also lead to optimization of existing gathering systems and compression when used on a field-wide basis. Wells at a greater distance from field compression will have greater line pressure losses to overcome compared to wells closer to the compressor for a given flow rate. By monitoring and regulating flow times and rates of all wells on the system as well as actual system pressures, the cloud 6 can determine the optimum time to produce wells further down the gathering system line by coordinating the flow time with pumping times of other wells on the system to lower the backpressure seen at the producing wells.

III. Method Embodying Aspects of the Invention

Figure 3A:
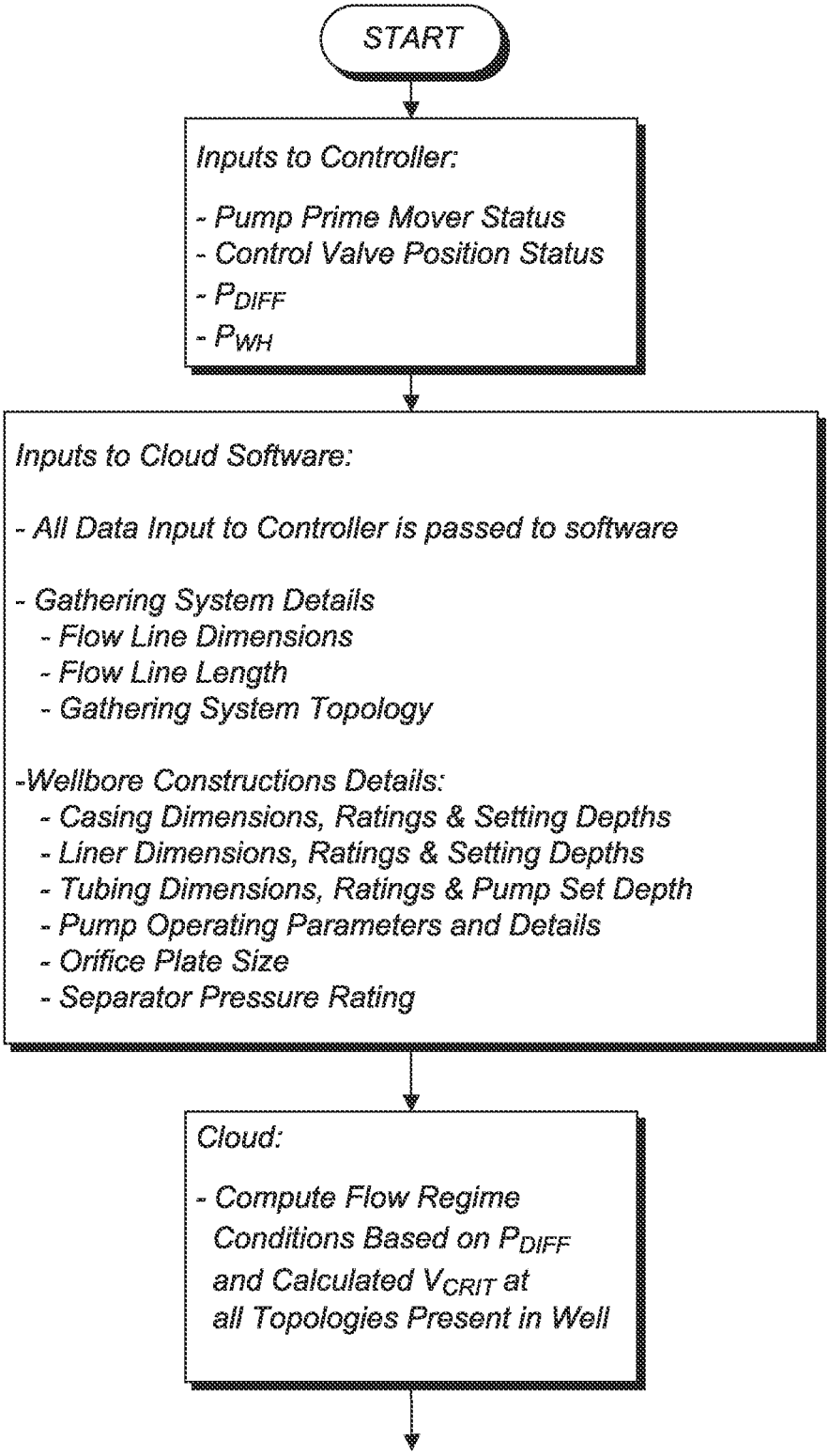
FIGS. 3*a*-3*c* show a flowchart of a method of the present invention.
Figure 3B:
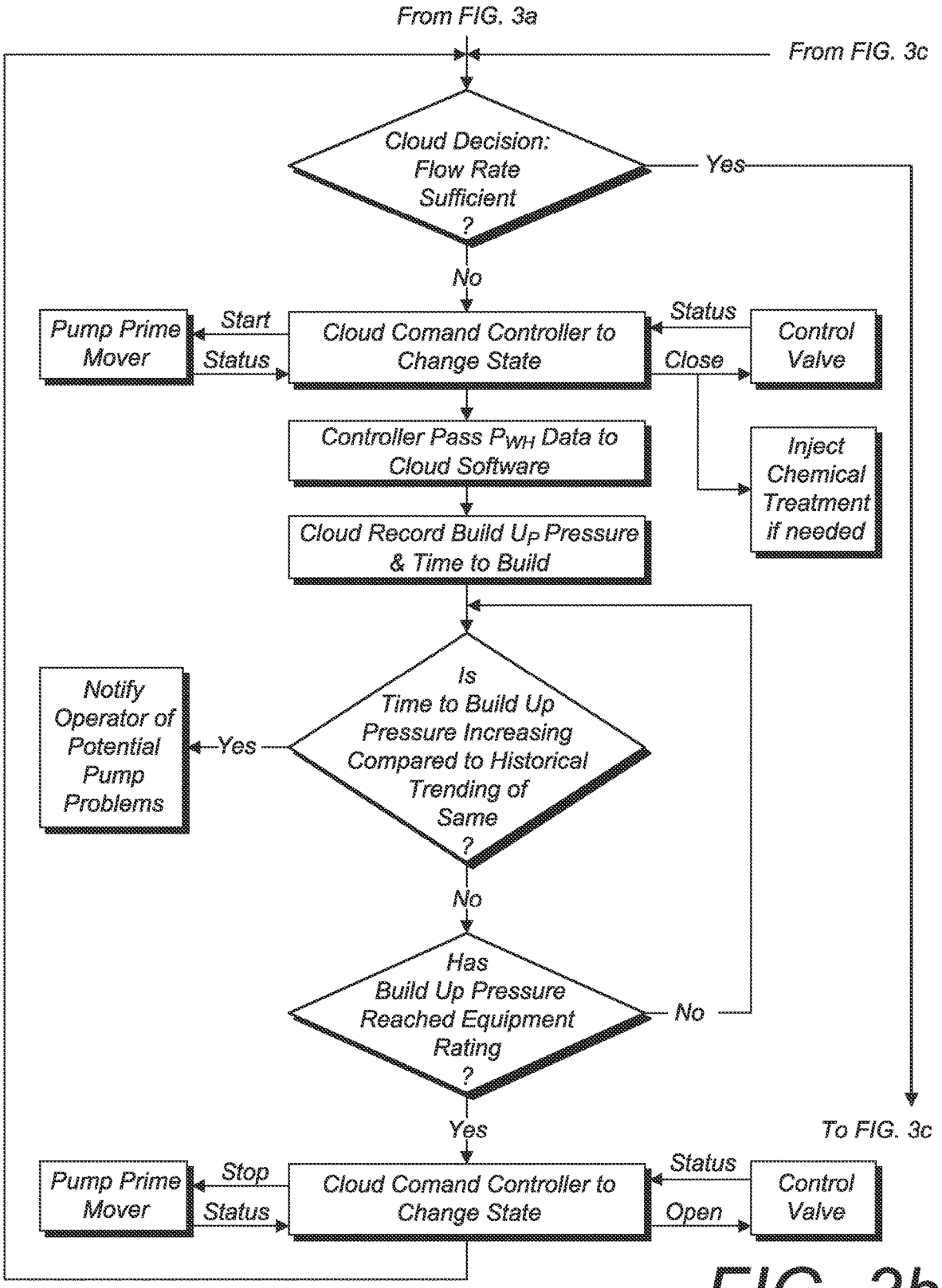
Figure 3C:
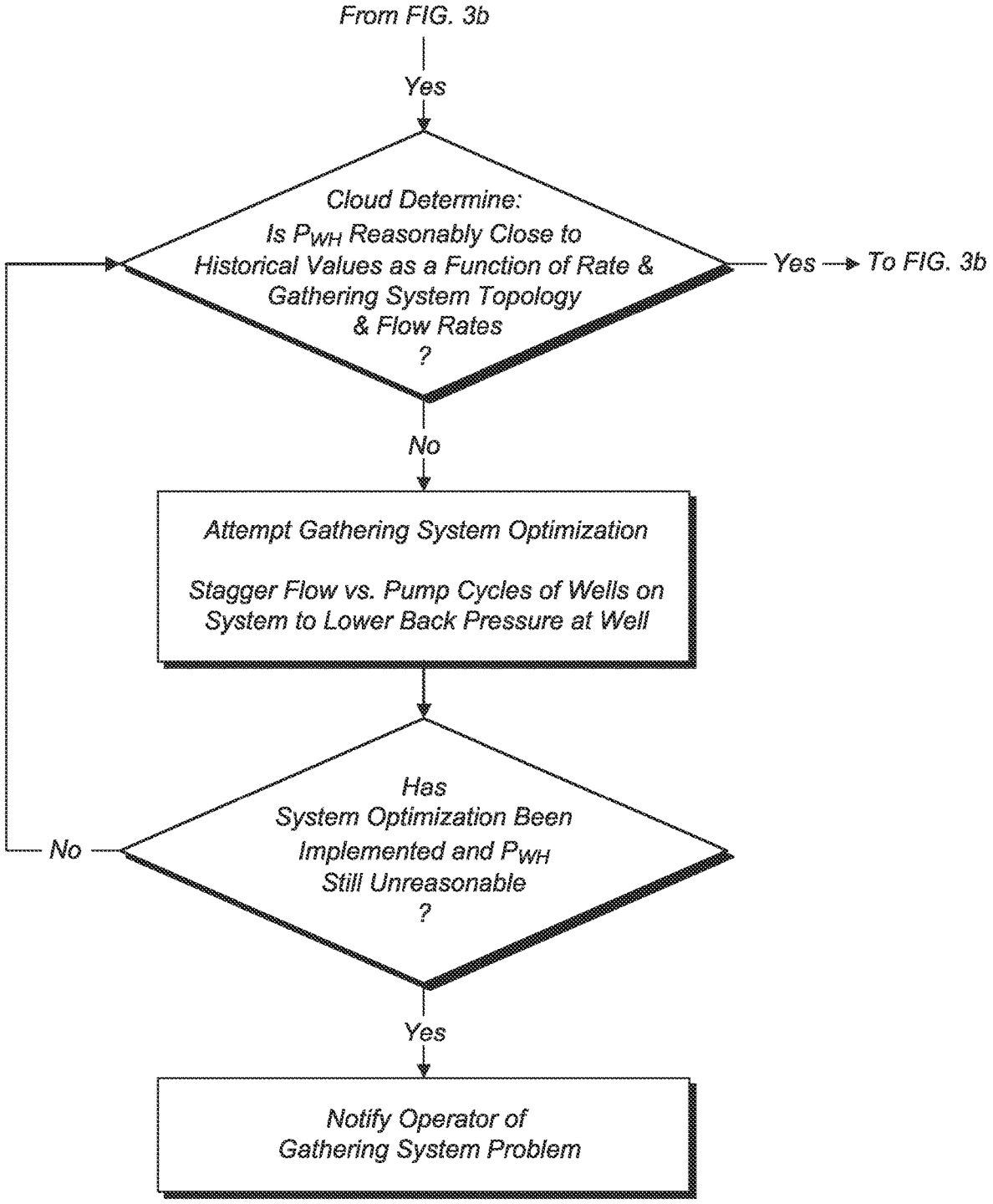

FIGS. 3*a*-3*c* show a flowchart for a non-limiting, exemplary method of practicing the present invention. Various other steps, sequences and operating parameters can utilize the inventive method.

IV. Systems Embodying Alternative Aspects of the Invention

Figure 4:
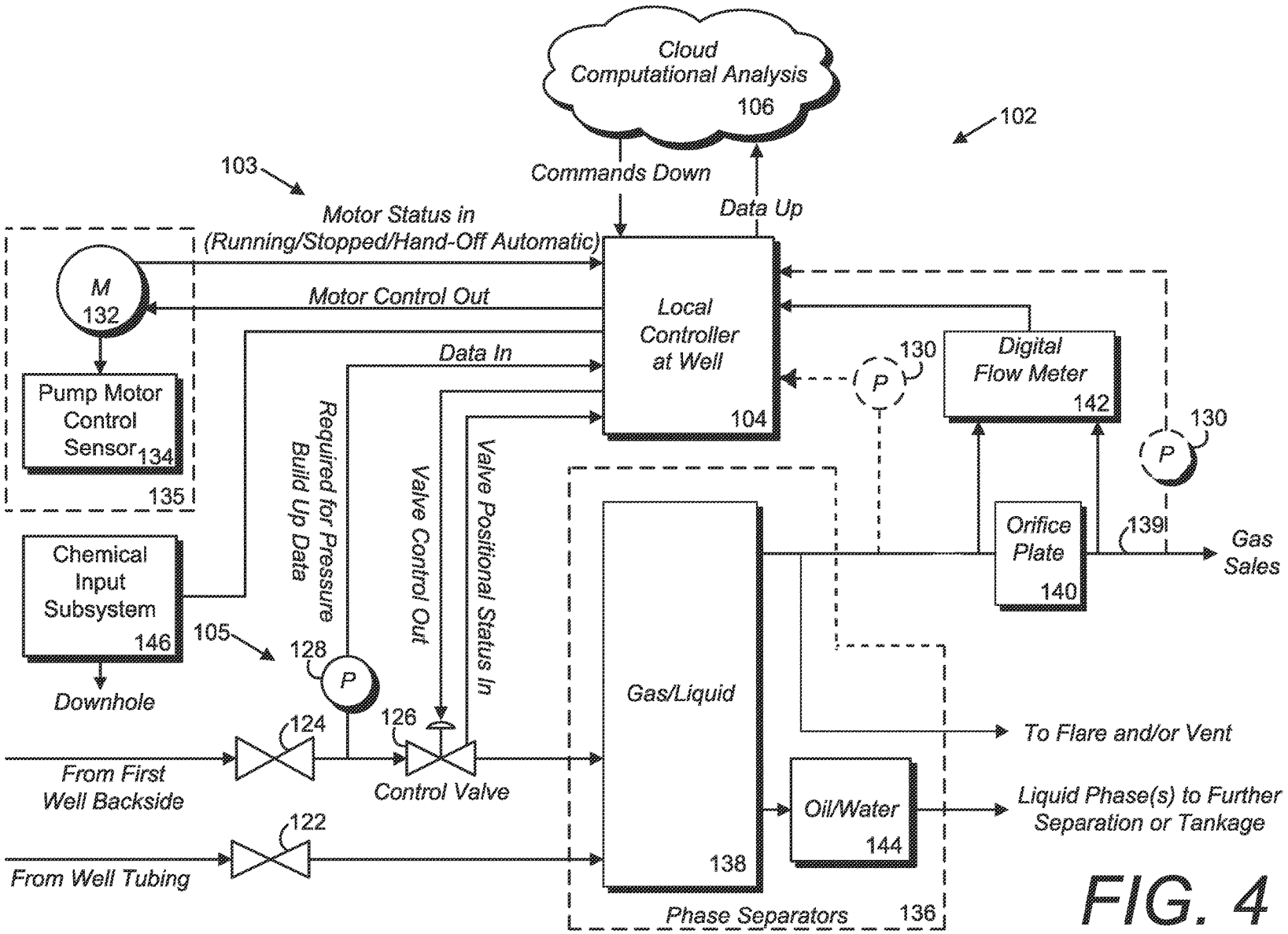
FIG. 4 is a schematic, block diagram of an oil and gas production well system embodying a modified or alternative aspect of the present invention.

FIG. 4 shows an oil and gas production well control system 102 comprising an alternative aspect or embodiment of the present invention and including a well 103 and a local controller 104. The local controller 104 can be connected to the Internet (i.e., "cloud") 106, e.g., wirelessly or directly. The system 102 can perform computational analysis in the cloud 106 by providing data input from the local controller 104, which can download commands from the cloud 106.

The system 102 includes a wellstring (multiple production wells can be included in the system and driven by a single-point cloud/software system), as shown in FIG. 5. Conventional production wellstrings can include an outermost casing, an intermediate liner and an innermost tubing. Such production wellstring components can be installed downhole as individual sections connected at their respective ends. Casings can be set-in-place downhole. Liners commonly terminate subsurface, and can be suspended from the casing by hangers. U.S. Pat. No. 7,090,027 shows casing hanger assemblies, and is incorporated herein by reference. The wellstring includes a first backside comprising an annular space between the liner and the tubing. A second backside comprises an annular space between the casing and the tubing. The wellstring is connected to a pump subsystem, which includes a motor and a pump motor control sensor. The pump subsystem motor can reciprocate a conventional pump jack (not shown), or drive various other downhole pump configurations, such as progressive cavity and electric submersible pumps. Various alternative production well constructions can include the control system and perform the method of the present invention.

As shown in FIG. 4, well tubing production (generally oil and water in liquid phase) exits a wellhead 105 via a tubing valve 122 and backside production (generally gas, which can include entrained liquids) exits the wellhead 105 via a backside valve 124, which flows through a control valve 126 connected to the local controller 104. The local controller 104 can be programmed to provide positioning signals to the control valve 126 in response to controller input, including control valve 126 positional status, preprogrammed operating parameters and conditions, and pressure data detected at upstream and downstream transducers 128, 130, which data can be utilized in computing system output flow rates.

The local controller 104 is also interactively connected to a motor or prime mover 132, which can include a pump motor control/sensor 134. The motor 132 can utilize variable frequency drive ("VFD") technology. Motor 132 status conditions can be running, stopped or hand-off automatic ("HOA"), which status conditions can be input to the local controller 104.

Production enters an existing surface phase separator subsystem 136 via pipe routing through valves 122, 126. The phase separator subsystem 136 includes a gas/liquid phase separator 138 wherein gas and liquid (i.e., oil and water) phases are separated. The gas flow proceeds down a sales line 139 that typically includes a differential pressure ($P_{DIFF}$) meter 142 to monitor and record the sold natural gas production. This measurement is done using typical gas parameters as a function of temperature and pressure, as well as using an orifice plate 140 of known restriction such that the instantaneous production rate can be calculated via the measured pressures on either side of the orifice plate 140. A difference in pressure between these two points of measurement ($P_{DIFF}$) indicates flow rate. The instantaneous well gas production is directly proportional to the $P_{DIFF}$ recorded at the meter 142, which records both orifice plate 140 well side and gathering line measured pressures, the calculated $P_{DIFF}$, and the calculated production flow rate as functions of time via an internal clock. If access to data from the sales meter is not available due to custody transfer, or other data and/or physical blockage issues, differential pressure can be derived by other means internal to the system 102. For many producing oil and gas wells it is not always the case that all gas produced can enter the gathering system 139 due to pressure limitations. Wells that find themselves in this operating condition will typically either flare (burn at site) or vent (to atmosphere) the excess gas. Wells with flaring systems would include a tee to the flare(s) between the separator 136 and the orifice plate 140 for the custody transfer sales gathering system meter 142. Wells that vent may vent from a dedicated line or may simply vent via a phase separator 136.

The production flow rate can be input to the local controller 104 if available via meter 142. Alternatively, $P_{DIFF}$ can be independently derived from the upstream and downstream pressure transducers 128, 130 if physical access to gathering system side of orifice plate is not possible. As shown in dashed lines in FIG. 4, the pressure transducer 130 can alternatively be located on either the operator (left in FIG. 4) side of the digital flow meter 142 and the orifice plate 140, or on the customer (right in FIG. 4) side. It should be noted that if data from a flow meter is available to the system for $P_{DIFF}$, then pressure transducer 130 is not required as part of the system.

Custody (ownership) of the gas output can transfer at the digital flow meter 142, which operates as a discrete external input source to the local controller 104. Alternatively, the custody transfer can occur downstream whereby the alternative configuration design choice based on an as-built design at the well site with upstream and downstream pressure transducers 128, 130 may be preferred. Such $P_{DIFF}$ is proportional to gas flow volume throughput and can provide quantity data as needed for the gas sales line 139 downstream of the system 102. Liquid output from the gas/liquid separator 138 enters an oil/water separator 144, and exits to further separation, disposal, oil sales, tankage, etc.

The system 102 uses instantaneous PDWF information and, via computation in a proprietary algorithm using cloud architecture, determines the optimal state of operation of both the downhole pump (controlled by the motor 132 located at the surface wellhead 105) and the automated control valve 126 between the well first backside or annulus and the gas/liquid separator 138, as shown in FIG. 4. The upstream pressure measurement transducer 128 (between the wellhead 105 and the control valve 126) inputs pressure data to the local controller 104 for use with flow meter 142 data. The PDWF can be supplied by the flow meter 142, or if this is not feasible, by using the wellhead upstream pressure transducer 128 in combination with the (optional) downstream transducer 130 inserted into the flowline on the downstream side of the last stage of separation for the gas. Ideally this would be on the gathering system side of the orifice plate, but if not possible, can be located upstream of the sales meter and derived separately. The control system 102 is pump "agnostic" and can be used with reciprocating tubing insert pumps, progressive cavity pumps, electric submersible pumps, etc.

In a high gas-flow-rate condition via the second back side, the operating downhole pump subsystem 135 will intake gas as well as liquids during the pumping cycle. In the same condition, a 'high' $P_{DIFF}$ state is present. During this condition there is no need to operate the pump subsystem 135, and the system 102 recognizes this regime condition and optimizes by the well local controller 104 opening the control valve 126 and maintaining the downhole pump subsystem 135 condition in "Off." As the well 103 continues to operate in this condition, both liquids and gas are flowing into the well 103, and both are attempting to flow via the backside. As the bottom hole pressure of the well struggles to lift both the liquids and gas from the well 103 due to an increase (gradual or sudden) in dynamic head, the flow rate decreases. This will be evidenced as decreasing $P_{DIFF}$ at the flow meter 142 (or independently derived as described elsewhere if flow meter 142 is not available). The cloud software 106 will continue monitoring $P_{DIFF}$ until the cloud-based algorithm determines a necessity to close the control valve 126 and begin a pumping condition cycle.

When the local controller 104 initiates the pumping condition, the control valve 126 is automatically closed, halting fluid upflow in the first backside ($V_{UPFLOW}=0$). Gravity segregation will naturally occur in this zero-velocity backside environment, and the liquid phases will 'fall' to the bottom of the well 103 for intake by the pump subsystem 135.

A chemical input subsystem 146 can be connected to the well 103 and controlled by the local controller 104 for better control of well chemical treatment. Treatment plans are commonly implemented with such chemical injection pumps and systems, which can inject anti-scaling, paraffin-eliminating and other control chemicals downhole. As the $P_{DIFF}$ naturally decreases after a flowing cycle and immediately after shutting in the control valve 126, the local controller 104 would initiate operation of the chemical input subsystem 146 (e.g., pumps) to place chemicals in the backside of the well 103 as it changes state from flowing backside production to gravity segregation in the pumping cycle.

The local controller 104 will then start the bottom-hole pump subsystem 135 via the (surface or downhole, depending on lift system employed at well) motor 132 and commence pumping since liquids are now at the pump intake and gas is segregating upward, thus creating a rising pressure seen at the pressure transducer 128 located near the control valve 126. The cloud 106 can either be programmed to calculate the fluid production by the pump based on well and pump operating parameters, or a sensor 134 can be added to the system 102 to actually measure the pump motor rotations or stroke rates with this data supplied to the local controller 104, thus enabling a more robust liquid production calculation.

The cloud 106 can incorporate machine learning techniques to optimize the well production as a function of run time of the pump subsystem 135, as well as establishing well performance optimization based on analysis of various pressure build up and flow-down rates and time frames seen at the control valve pressure transducer 128 and $P_{DIFF}$, respectively. Certain wellbore construction and operating parameters are input into the software architecture and the software will determine superficial gas velocities for all wellbore topologies present. The system 102 will estimate critical velocities for each discrete wellbore topology and will use this information as a baseline for determining the starting point for the shut-in state of the system 102, thus maximizing the in situ well energy, decreasing gas volumes that are vented and/or flared thereby improving local air quality in addition to increasing the expected ultimate reserves recovery of the well. During the shut-in phase, the system 102 will monitor, record and learn from the nature of the pressure buildup: slope(s) of buildup, time to build to certain pressures, etc. The cloud 106 can be programmed to perform a time to frequency transformation on each buildup and flow down pressure cycle and note the frequency domain and distribution of same, comparing changing harmonic signatures with various production and pressure buildup characteristics in determining the state of inflow performance while flowing and pump state while pumping.

The control system 102 can warn of impending pump failure by continually analyzing the time cycle duration and subsequent number of pump strokes required to obtain a given backside pressure buildup. The control system 102 will also lead to optimization of existing gathering systems and compression when used on a field-wide basis. Wells at a greater distance from field compression will have greater line pressure losses to overcome compared to wells closer to the compressor for a given flow rate. By monitoring and regulating flow times and rates of all wells on the system as well as actual system pressures, the cloud 106 can determine the optimum time to produce wells further down the gathering system line by coordinating the flow time with pumping times of other wells on the system to lower the backpressure seen at the producing wells.

Continuous monitoring of pressures and flow rates of the produced well-gas also allows the system 102 to potentially decrease or eliminate the amount of flared and or vented gas. System 102 flare-volume control capacity is dependent on both well and gathering system restraints. However, the system 102 can inherently sense whether the well can or cannot flow gas into the gathering system via measurement from pressure transducers 128 and 130. Should access to a local custody transfer meter 142 be available, then sales gathering system 139 pressure status would be known from 142 in lieu of transducer 130 with 130 being redundant to the system. Natural gas going to flare or vent is caused by one of two limiting boundary conditions, both of which are constantly and routinely monitored by the control system 102. Limiting boundary condition 1 occurs when the sales gathering system 139 pressure exceeds that of the well, measured by pressure transducer 128. Limiting boundary condition 2 occurs when the well pressure at transducer 128 exceeds the value allowed by the gathering system 139. This gathering system limited pressure value would be one of the inputs to the system program as referenced in FIG. 5*a*. Flaring/venting volume reduction by system 102 to boundary condition 1 involves controlling control valve 126 such that pressure is built up within the well allowing access to the gathering system when low well head pressure occurs, directly correlating to low gas velocity. Flaring/venting volume reduction by system 102 to boundary condition 2 involves regulating the pressure drop across control valve 126 via instantaneous throttling of same to create a suitable pressure drop allowing well gas to the enter the gathering system. Over time the system 102 records and accurately predicts pressure buildup as a function of time from historical data limiting the pressure overshoot as one of the functions of the machine learning software. Systems Embodying Alternative Aspects of the Invention

Figure 5A:
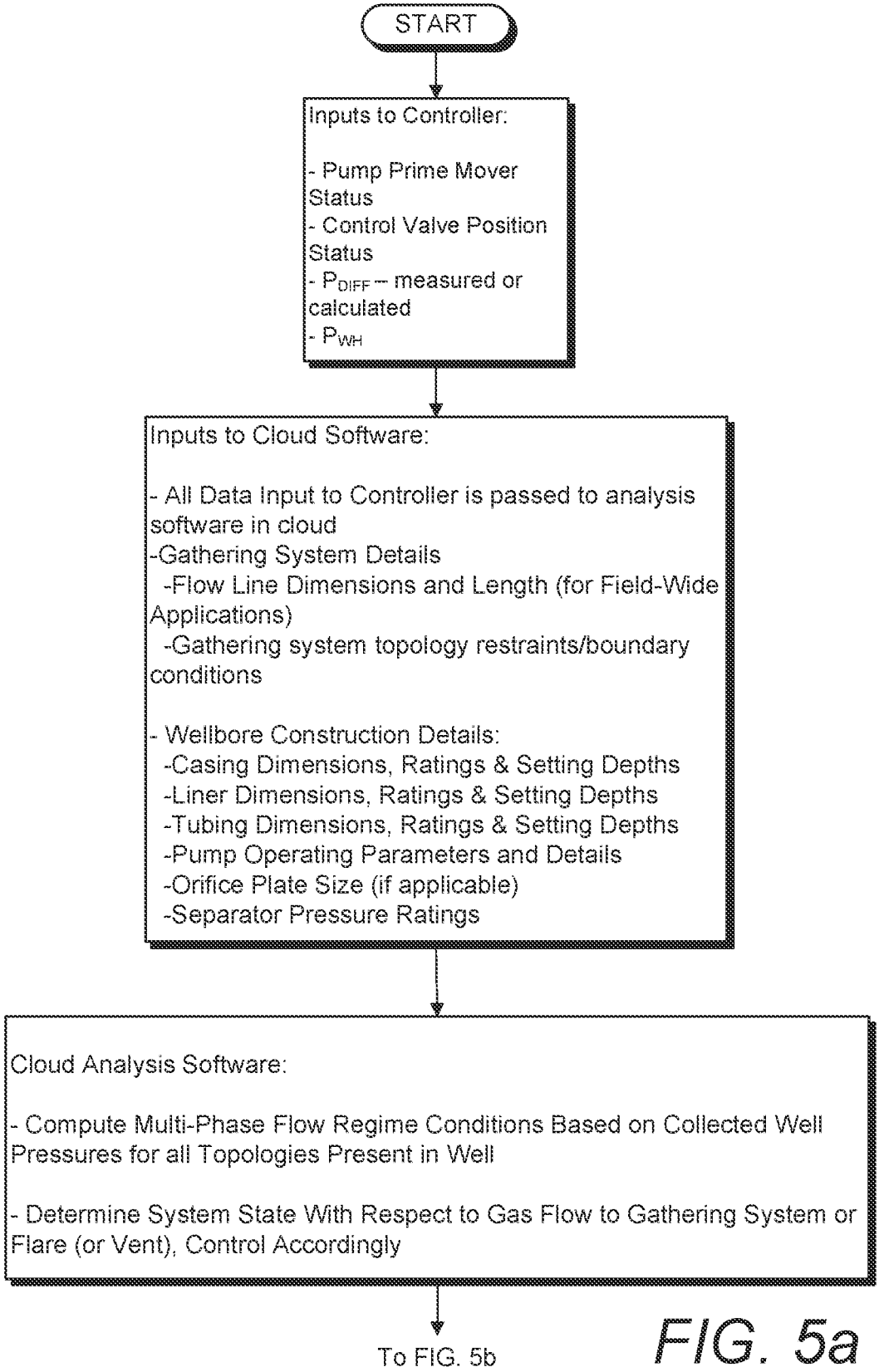
FIGS. 5*a*-5*c* show a flowchart of a modified or alternative embodiment method of the present invention.
Figure 5B:
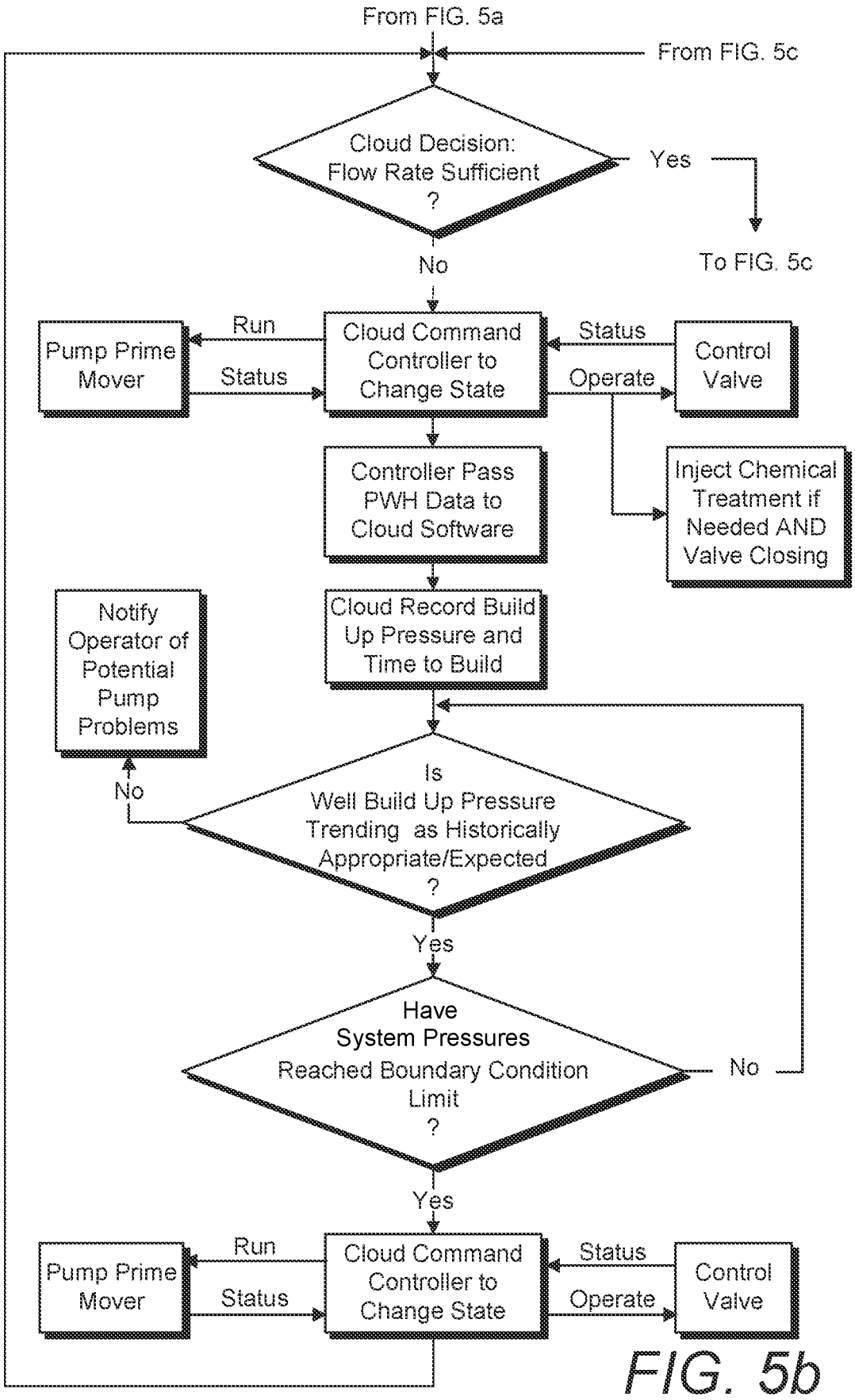
Figure 5C:
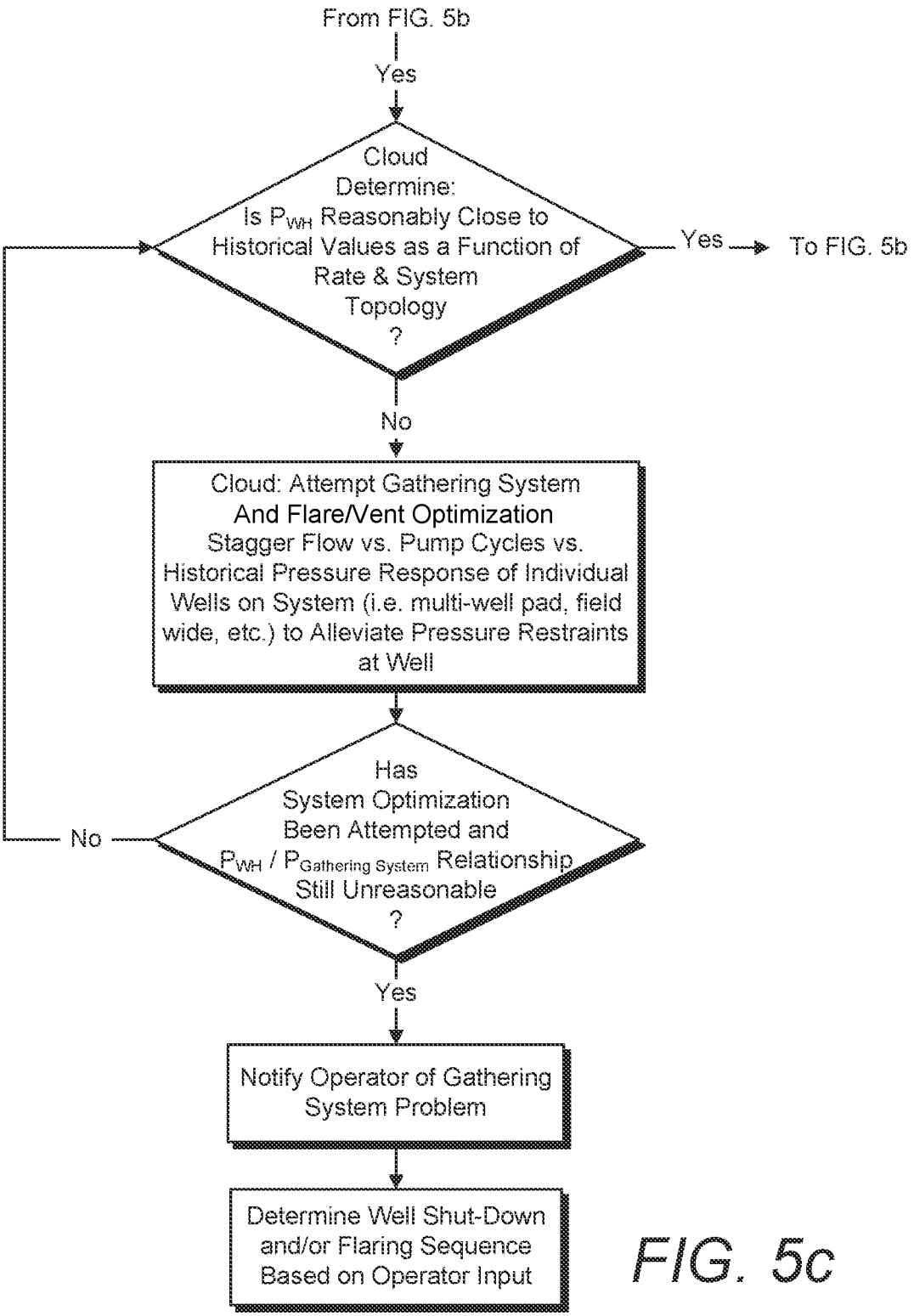

V. Methods Embodying Additional Alternative Aspects or Embodiments of the Invention FIGS. 5*a*-5*c* show a flowchart for a non-limiting, exemplary method of practicing the present invention. Various other steps, sequences and operating parameters can utilize the inventive method.

Figure 6A:
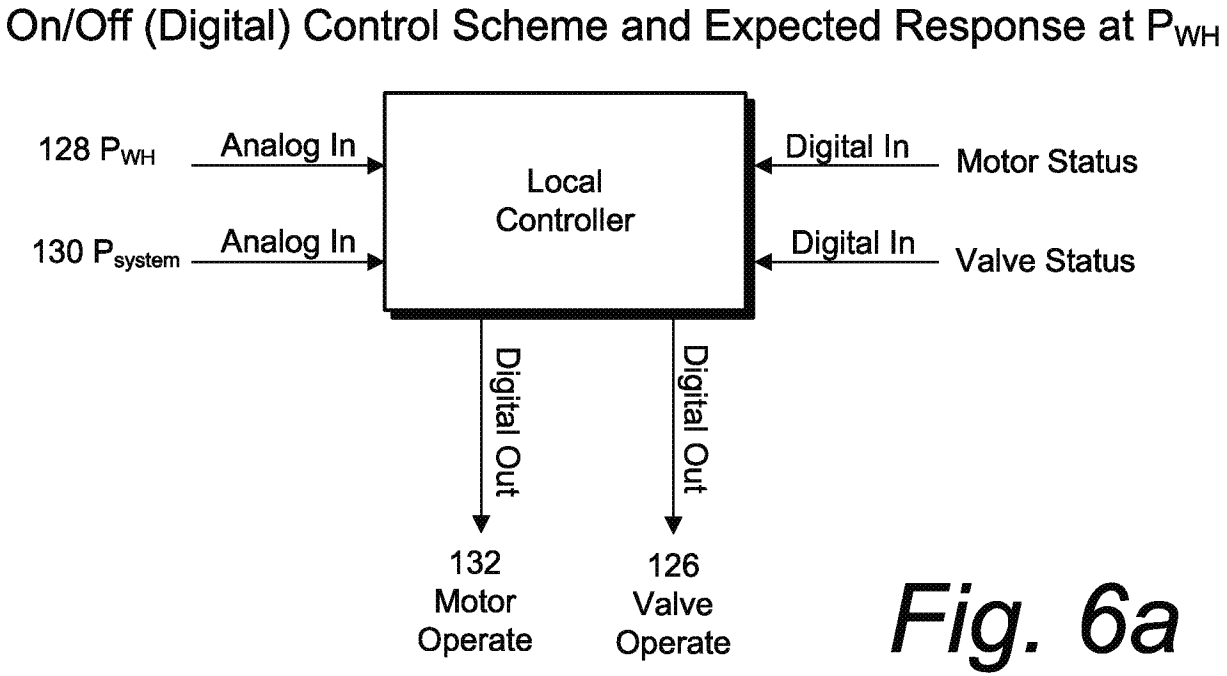
FIGS. 6*a*-6*c* show a simple digital (on/off) control scheme for use with the system and method of the present invention.
Figure 6B:
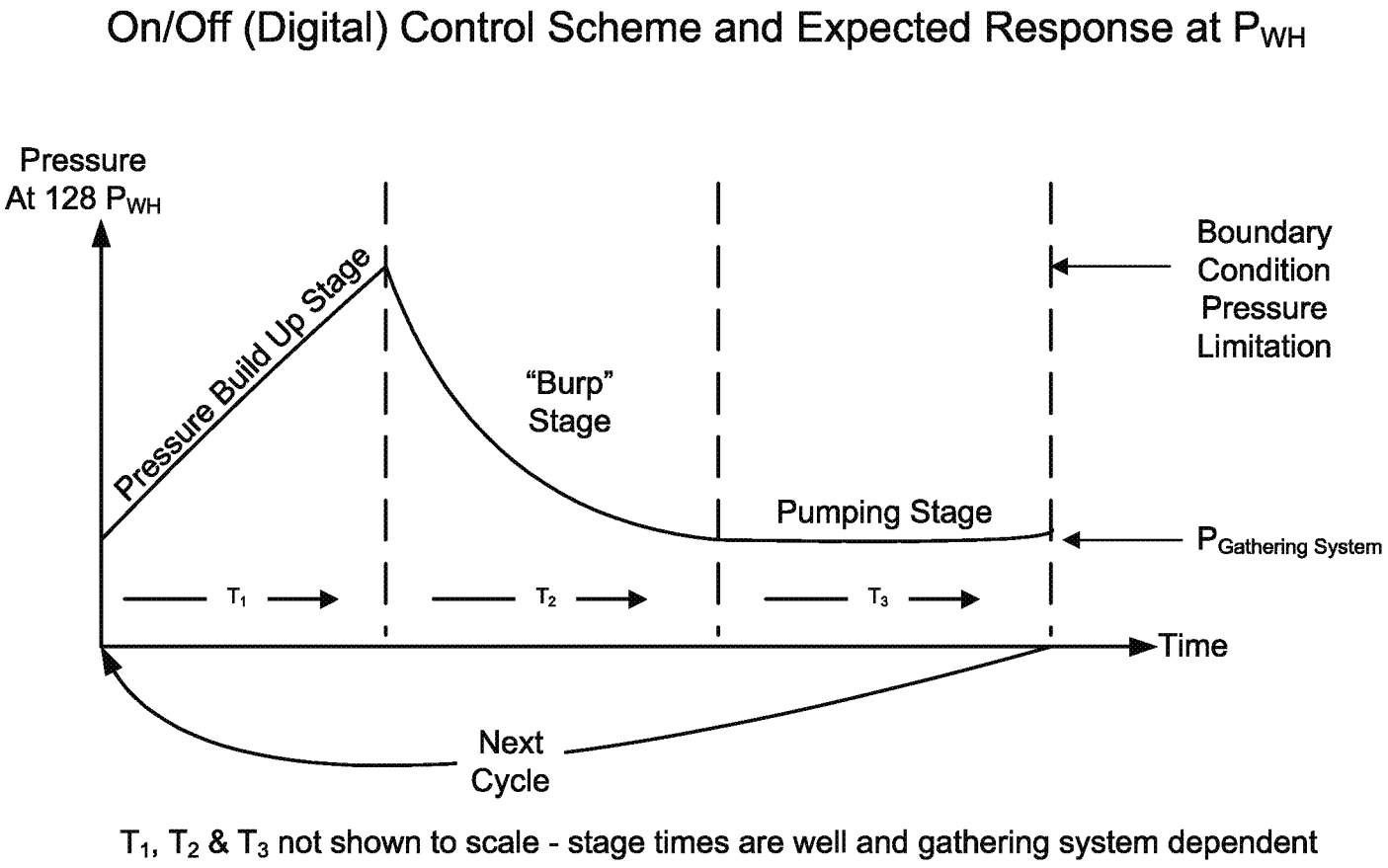
Figure 6C:
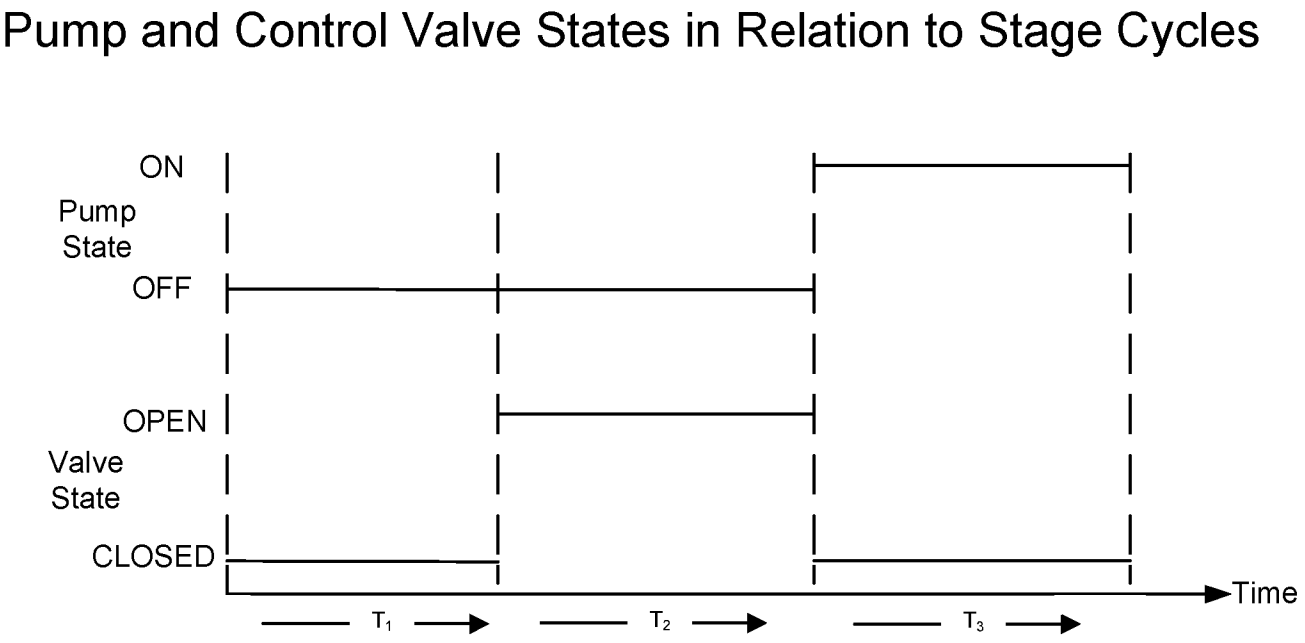

FIGS. 6*a*-6*c* show a digital (binary, on/off) control scheme for the present invention with the local controller 104 configured for receiving various operating parameter inputs and providing outputs including valve and motor operating signals at 126 and 132, respectively. Sequential stage times are shown in a pressure vs. time graph (FIG. 6*b*) for a repetitive cycle with a pressure build-up stage, a "burp" stage and a pump stage. FIG. 6*c* shows the pump states (on and off) and the valve states (open and closed) in relation to the stage cycles.

Figure 7A:
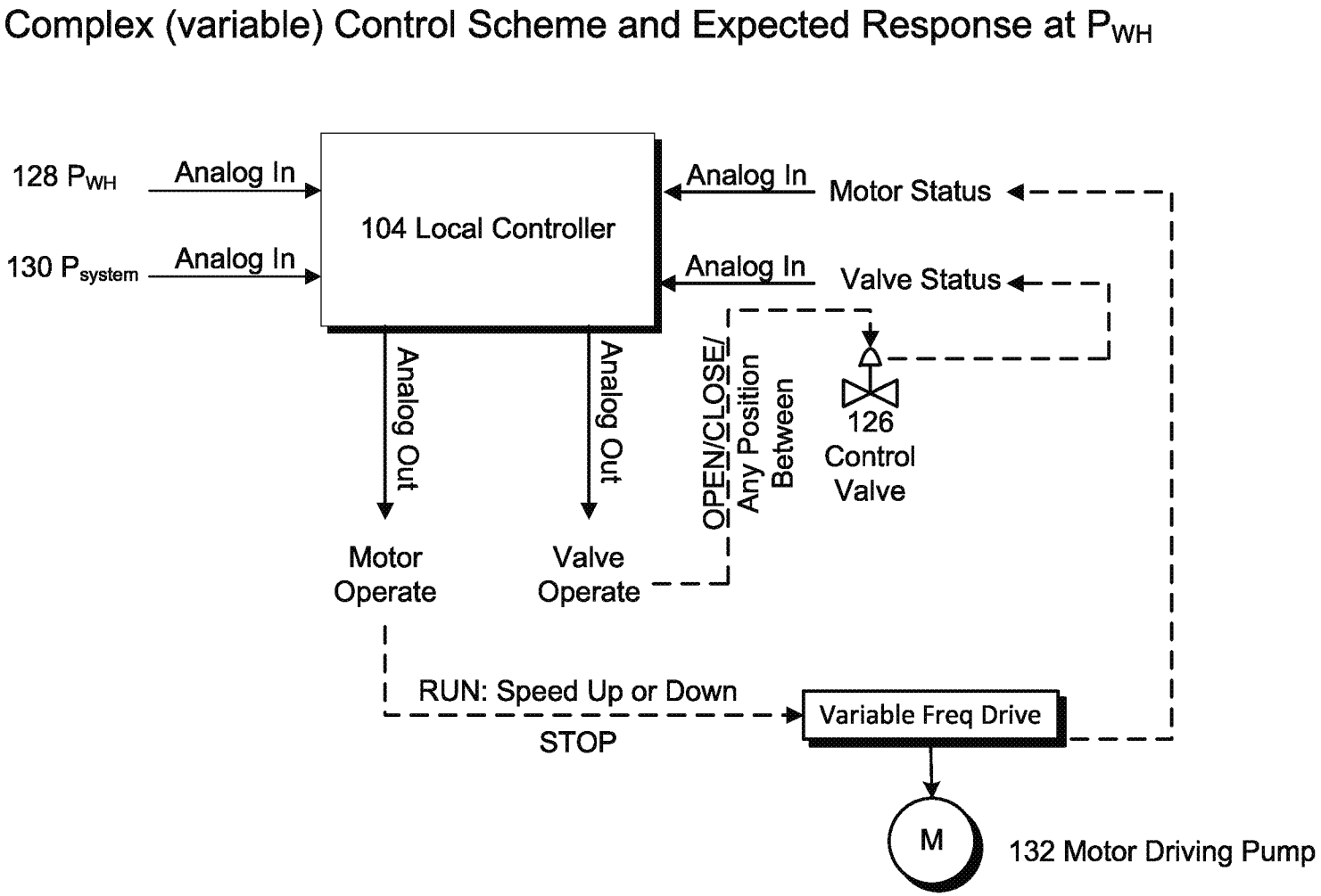
FIGS. 7*a*-7*c* show a complex (variable) control scheme for use with the system and method of the present invention.
Figure 7B:
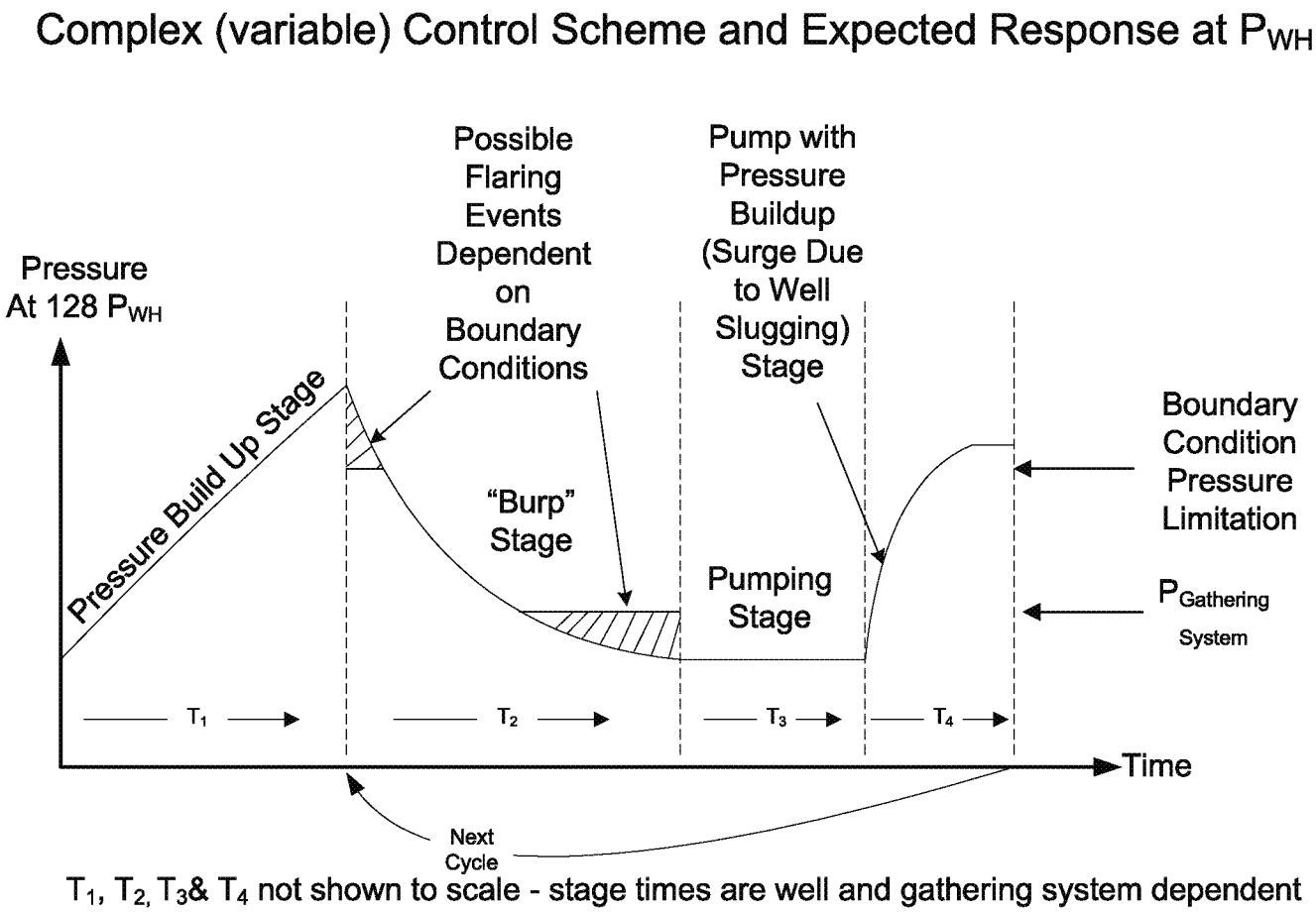
Figure 7C:
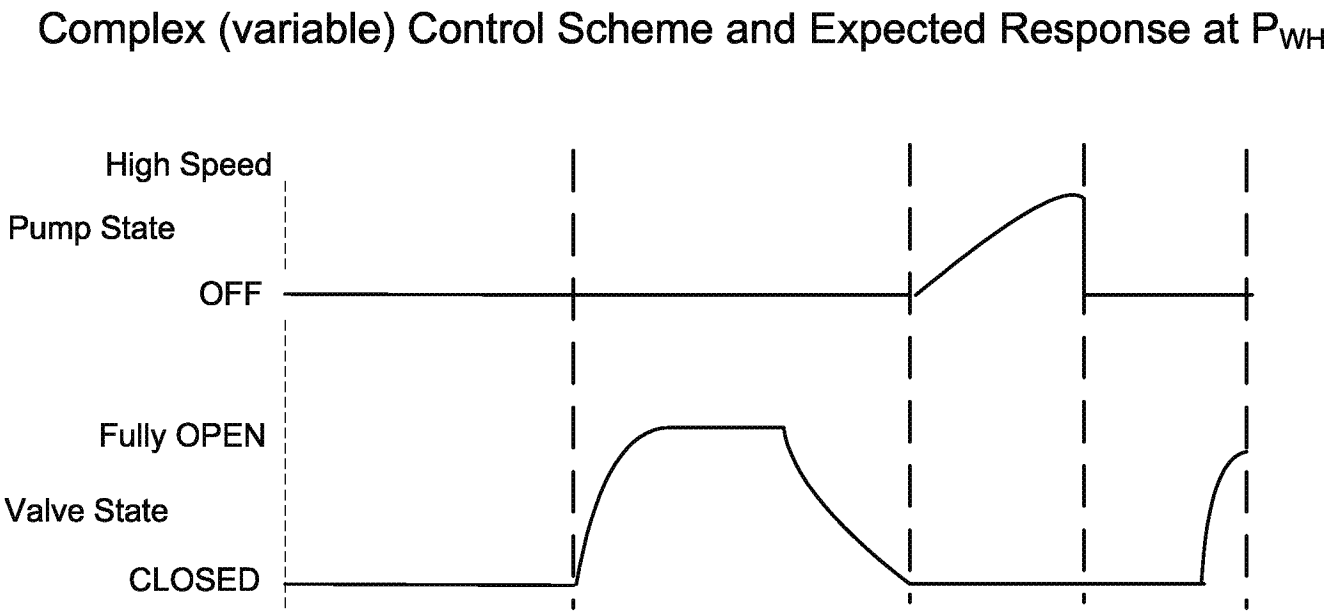
Figure 8:
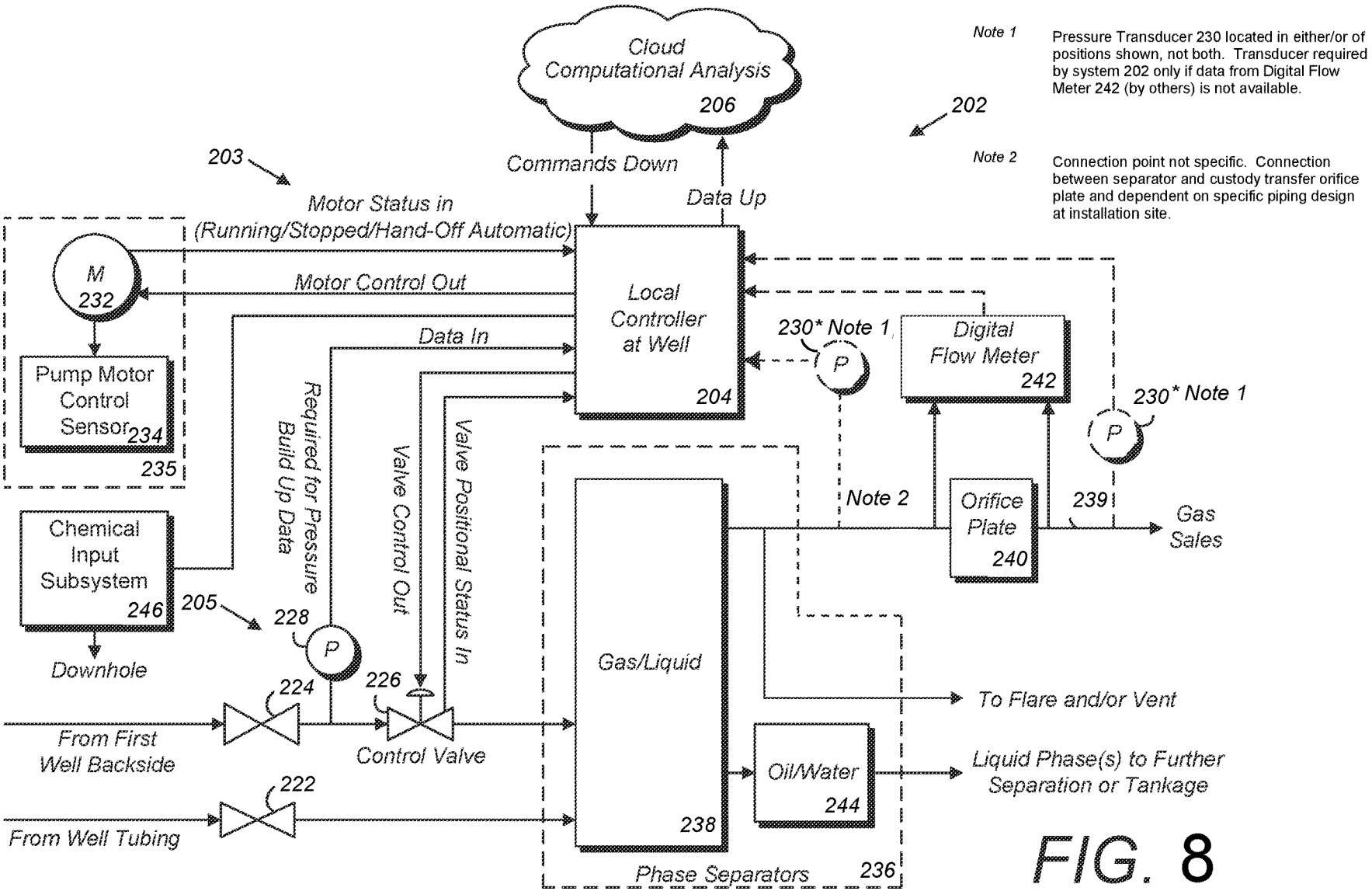
FIG. 8 shows a schematic, block diagram of an oil and gas production well system embodying another modified or alternative aspect of the present invention with carbon capture, anti-flaring and anti-venting features.

FIGS. 7*a*-7*c* shows a complex (variable) control scheme for the present invention, with a local controller 104 receiving analog inputs for motor and valve status. Analog outputs control motor and valve operation. For example, the motor control outputs can control speed and run/stop. A variable frequency drive (VFD) can receive such output signals and can be connected to the pump motor 132. The VFD can provide position information corresponding to valve status (variable between open and closed) in a feedback loop with valve status as an analog input to the local controller. FIG. 7*b* further shows a chart of pressure vs. time for pump cycles, e.g., pressure build-up stage, "burp" stage (lost sales) and the pressure effects of well slugs on the pump during the slugging stage. The pressure values corresponding to the pump and valve states are also shown. Valve control signals from the local controller 104 generally respond to the pressure values sensed in the system. Pump states ranging from off to highest speed and valve states ranging from closed to fully open are also shown corresponding to different system pressure stages (e.g., build-up, gas to sales, possible gas flare and pump and pressure surge buildup due to slugging stage).

The present invention enables operators to minimize flaring by proactively controlling well-specific pressure build-ups and well loading. Sufficient gas quantities can be accumulated from a producing well or field to enable cost-effective storage, transport and commercial sales. Ratios of gas quantities sold vs. flared can be increased. Various mathematical modeling techniques can be utilized with the present invention. For example, regression analysis techniques using parameters such as pressures, oil and gas pricing and futures markets can be factored in to optimize profitability. Moreover, oil and gas well producing controls of the present invention can be utilized by operators in determining wells to "kill" (e.g., with fluid), reactivate and maintain in reserve. Such parameters also affect mineral rights lease values and other commercial business management considerations.

VI. Additional Alternative Aspects or Embodiments of the Invention

FIGS. 8-11 show another modified or alternative embodiment of the present invention comprising a gas capture, anti-flaring and anti-venting system 202. A motor control subsystem 203 includes a local controller at the well 204, a well pump system 205, computational analysis (e.g., in the cloud) 206 receiving data uploaded from the local controller 204 and downloading commands thereto.

The well pump system 205 receives oil and gas from the well tubing, at a well tubing manual valve 222. A chemical input subsystem 246 can be connected to the well 203 and controlled by the controller 4 for controlling well treatment. Input from the first well backside is received at manual valve 224 and proceeds to an adjustable control valve 226 for input to phase separators 236, including a gas/liquid phase separator 238 and an oil/water separator 244. Output from the gas/liquid separator can be received by an orifice plate 240 for supplying gas sales. A digital flow meter 242 can receive output from the gas/liquid phase separator 238, either upstream or downstream of the orifice plate 240. A pressure transducer 230 can also be connected either upstream or downstream of the orifice plate 240 and provides signal input to the local controller 204. The pressure transducer 230 can be eliminated from the system 202 if data from the digital flow meter 242 is available. Third parties, such as customers, pipeline operators and others, can provide the digital flow meter 242. Moreover, the connection between the phase separators 236 and the custody transfer orifice plate 240 can be specific to the piping design at the installation site and accommodate transactions among producers, customers and others involved in energy transactions.

Figure 9:
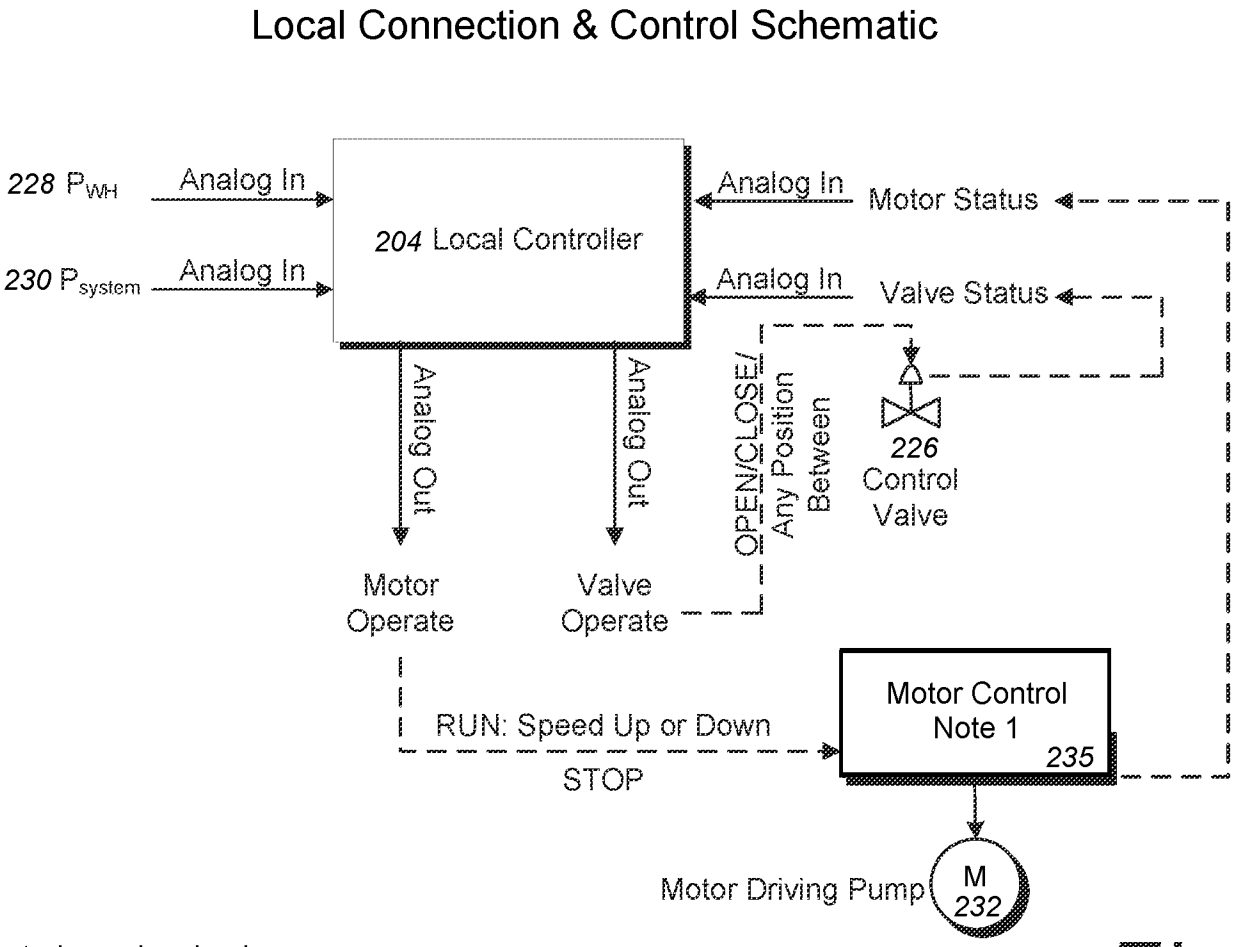
FIG. 9 shows a local connection and control schematic for the system shown in FIG. 8.

FIG. 9 shows a load connection and control schematic for the system 202. Wellhead pressure 228 and gathering system 239 pressure 230 are input as analog signals to the local controller 204, which also receives analog input from: the motor control subsystem 235 controlling the motor-driving pump 232; and the control valve 226. The control valve 226 can be controlled by analog output from the local controller 204 through a valve operation function. Valve control can be adjustable from fully open to fully closed and thus accommodate system operating parameters. The motor control 235 can likewise provide variable speed control, e.g., via a variable frequency/speed drive. Alternatively, a simplified motor control 234 can provide ON/OFF via digital contact control.

Figure 10:
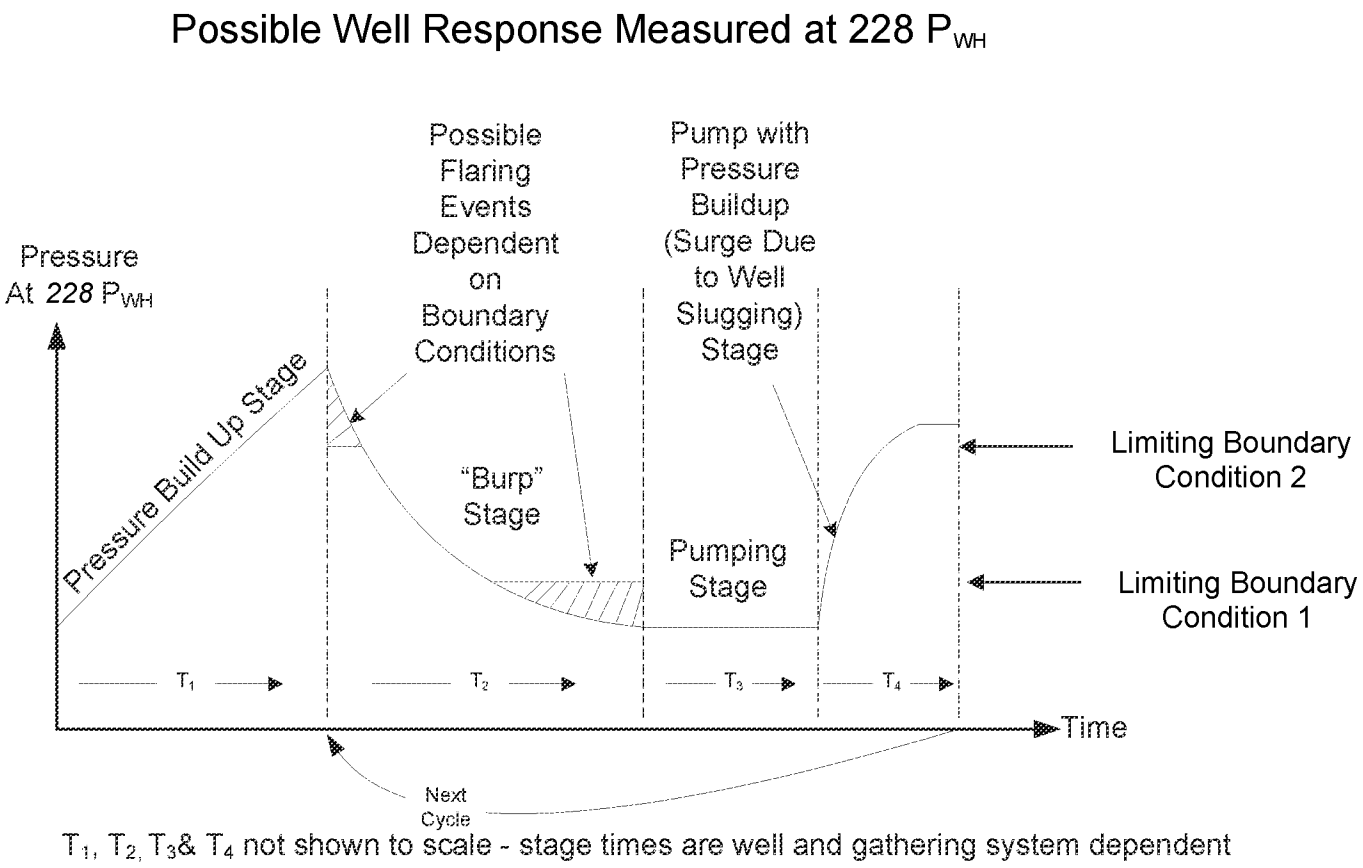
FIG. 10 is a diagram showing well response as a function of wellhead pressure with respect to time for the system.
Figure 11:
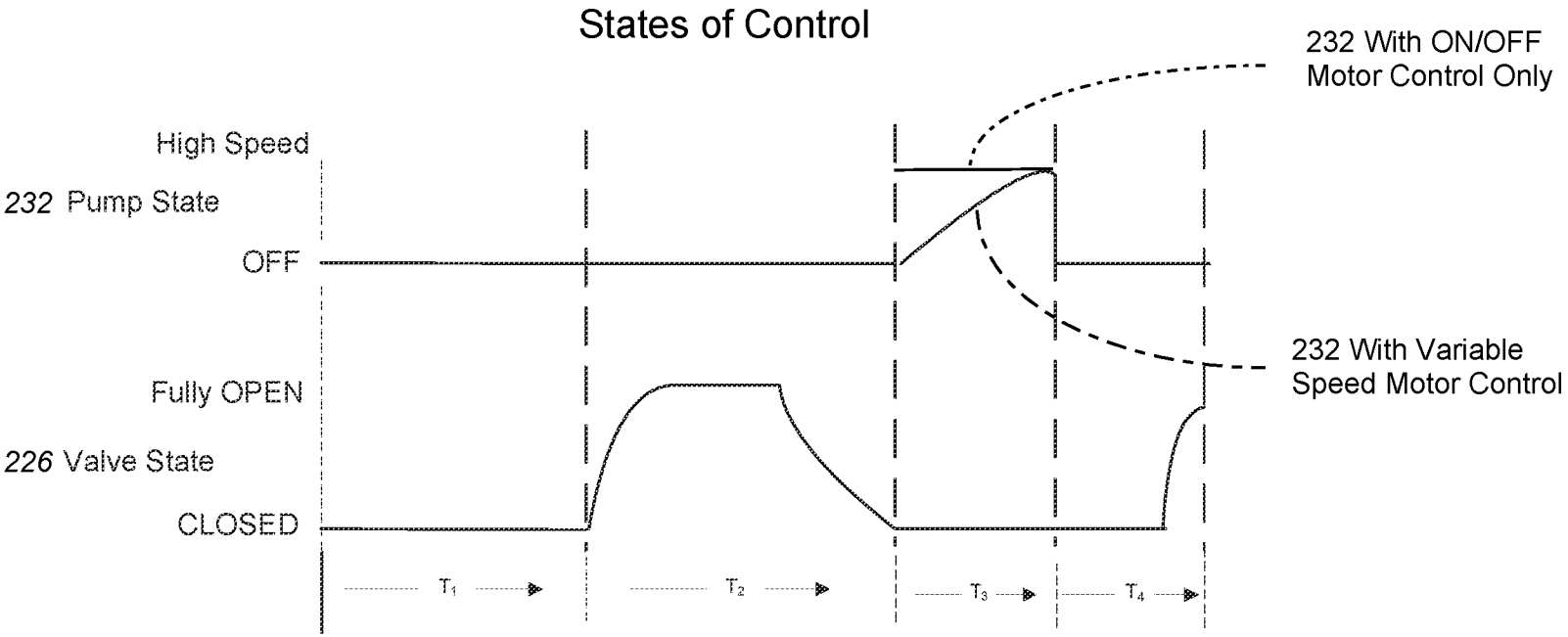
FIG. 11 shows states of control for the system.

FIG. 10 shows projected well responses as a function of wellhead pressure, which can be determined at the pressure transducer 228. The wellhead pressure responses change through pressure buildup, "burp," pumping and pressure buildup from a surge due to well slugging. Limiting boundary conditions 1 and 2 are shown as pressure points for reference. FIG. 11 shows states of control with respect to pump state, valve state, and motor control.

The control system 202 can be configured for further optimizing gas capture and thus minimizing or eliminating gas venting and flaring. The negative environmental impact of oil and gas production, and the corresponding "carbon footprint," can likewise be reduced. For example, the harmonic signatures with various production and pressure buildup characteristics in determining the state of inflow performance while flowing and the pump state while pumping natural gas are controllable with the system 202. Natural gas flaring and venting are functions of boundary conditions being exceeded. A first limiting boundary condition occurs when the sales gathering system 239 pressure exceeds wellhead pressure, measured at the transducer 228. A second boundary limiting condition occurs when the wellhead pressure at the transducer 228 exceeds the value allowed by the gathering system 239. The gathering system pressure values, and the corresponding limits, are numerical inputs to the controller, either the local controller 204 at the well, or to the cloud for computational analysis at 206. The control valve 226 and the pump motor control 235 can be interactively controlled and adjusted to achieve and maintain optimal operating conditions. The control system 202 records and accurately predicts pressure buildup as a function of time from historical data limiting the pressure overshoot as one of the functions of the machine learning software.

VII. Conclusion

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A control system for an oil and gas production well including: a subsurface borehole; casing lining the borehole; a liner within the casing; tubing with lower and upper ends; said tubing located within the casing; an annular casing-tubing backside between the casing and the tubing; a downhole pump connected to said tubing lower end; a prime mover connected to said downhole pump; and a surface wellhead connected to said tubing upper end, said surface wellhead receiving at a production flow rate primarily oil production through said tubing and primarily gas production through said casing-tubing backside, said control system including:

a control valve connected to said casing-tubing backside and said surface wellhead;

a programmable controller connected to said pump prime mover, said casing-tubing backside and said surface wellhead, said controller configured for adjustably controlling the production flow rate to said wellhead;

said controller configured for accessing a cloud-based program with a control algorithm configured for: equating the gas flow rate at the pump to the backside gas flow rate as computed from measurements taken at the surface; computing a predicted instantaneous gas velocity at the downhole pump based on operating parameters specific to said well; correlating gas velocity at said pump with gas volume intake to said pump; analyzing the relationship between surface backside pressure and sales gathering system pressure data, regulating well pressure and gas flow rate via said control valve; and reducing or eliminating gas venting and/or gas flaring.

2. The control system according to claim 1 wherein said well operating parameters include differential pressures ($P_{DIFF}$) and production fluid uphole velocities.

3. The control system according to claim 2, which includes:

a gas output line connected to said well backside; and a controller input $P_{DIFF}$ determined along said well backside to said gas output line.

4. The control system according to claim 3 wherein:

said cloud-based program is configured for controlling a pump motor based on said well operating parameters.

5. The control system according to claim 1, which includes:

a fluid output of said production well;

a phase separator connected to said fluid output; and said phase separator configured for separating gas and liquid phases of said fluid output.

6. The control system according to claim 1 wherein said controller controls a flow of gas from said phase separators to an outlet for flaring or venting.

7. The control system according to claim 1, which includes:

an oil and gas production field including multiple wells;

each said well including a respective well control system with a local controller configured for controlling a pump motor;

said local controller receiving inputs corresponding to well operation parameters from multiple sensors mounted on said well;

said local controller connected to a centralized controller programmed for computational analysis and communicating with each said local controller; and said centralized controller programmed for optimizing production of said oil and gas field by independently controlling production of said individual wells.

8. The control system according to claim 1 wherein said control system is configured for transforming surface backside pressure from time domain to frequency domain.

9. The control system according to claim 8 wherein said time-to-frequency domain transformation comprises a Fast Fourier Transform.

10. The control system according to claim 3, wherein said control system is configured for monitoring changes in frequency attenuation and harmonic distribution of said surface backside pressure as a function of control valve position and said pump prime mover operation.

11. The control system according to claim 4 wherein said control system is configured for detecting transient changes in the state of gas flow in the well and operational changes in the pumping system components.

12. The control system according to claim 5, wherein said control system is configured for commanding a state change of the control valve position and the pump prime mover operation in response to said transient changes in the state of gas flow and said operational changes in the pumping system components.

13. The control system according to claim 1 wherein said prime mover is located downhole.

14. The control system according to claim 1 wherein said downhole pump comprises an electric, submersible pump (ESP).

15. The control system according to claim 1 wherein: said control system recognizes when produced gas flow is being routed to vents and/or flares and takes action to minimize the volume of gas allowed to vent and/or flare.

16. A centralized control system for an oil and gas production field including multiple individual production wells, which includes:

each individual production well having: a subsurface borehole; casing lining the borehole; a liner within the casing; tubing with lower and upper ends and located within the casing; an annular casing-tubing backside between the casing and the tubing; a downhole pump connected to said tubing lower end; a prime mover connected to said downhole pump; and a surface wellhead connected to said tubing upper end, said surface wellhead receiving at a production flow rate primarily oil production through said tubing and primarily gas production through said casing-tubing backside;

each well having a localized control system including; a control valve connected to said casing-tubing backside and said surface wellhead; a programmable controller connected to said pump prime mover, said casing-tubing backside and said surface wellhead, said controller configured for adjustably controlling the production flow rate to said wellhead;

said centralized control system connected to said localize control systems and configured for accessing a cloud-based program with a control algorithm configured for: equating the gas flow rate at each pump to the backside gas flow rate as computed from measurements taken at the surface; computing a predicted instantaneous gas velocity at each downhole pump based on operating parameters specific to each said well; and correlating gas velocity at each pump with gas volume intake to said pump;

analyzing the relationship between surface backside pressure and sales gathering system pressure data, regulating well pressures and gas flow rates via said control valves; and said centralized controller programmed for optimizing production and reducing or eliminating gas venting and/or gas flaring of said oil and gas field by independently controlling production of said individual wells.

* * * * *